US008671510B2

(12) United States Patent
Han et al.

(10) Patent No.: US 8,671,510 B2
(45) Date of Patent: Mar. 18, 2014

(54) HAND-HELD AND STICK VACUUM CLEANER

(75) Inventors: Jung-gyun Han, Gwangju (KR); Ki-man Kim, Gwangju (KR); Seog-bong Baek, Busan (KR); Dong-jun Kim, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 483 days.

(21) Appl. No.: 13/067,364

(22) Filed: May 26, 2011

(65) Prior Publication Data

US 2011/0289719 A1 Dec. 1, 2011

Related U.S. Application Data

(60) Provisional application No. 61/349,938, filed on May 31, 2010.

(30) Foreign Application Priority Data

Sep. 30, 2010 (KR) ..... 10-2010-0095024

(51) Int. Cl.
*A47L 5/00* (2006.01)

(52) U.S. Cl.
USPC ..... 15/329; 15/353; 15/344

(58) Field of Classification Search
USPC ..... 15/328, 329, 353, 344
IPC ..... A47L 5/00
See application file for complete search history.

(56) References Cited

U.S. PATENT DOCUMENTS

| | | | |
|---|---|---|---|
| 5,819,364 | A | 10/1998 | Sham |
| 2007/0136984 | A1 | 6/2007 | Hsu |
| 2007/0163075 | A1 | 7/2007 | Butler et al. |
| 2007/0271724 | A1 | 11/2007 | Hakan et al. |
| 2008/0289306 | A1 | 11/2008 | Han et al. |
| 2010/0083459 | A1 | 4/2010 | Beskow et al. |

FOREIGN PATENT DOCUMENTS

| | | | |
|---|---|---|---|
| DE | 88 14 124 | U1 | 11/1988 |
| EP | 1 952 743 | A2 | 9/2007 |
| EP | 1994870 | A2 | 11/2008 |
| EP | 2 201 875 | A2 | 12/2009 |
| JP | 9-206247 | | 8/1997 |
| JP | 2000-41909 | | 2/2000 |
| KR | 10-2008-0102647 | | 11/2008 |
| WO | 2008/088278 | A2 | 7/2008 |

OTHER PUBLICATIONS

Extended European Search Report issued Jun. 11, 2013 for European Patent No. 11167786.0.
Extended European Search Report issued Jun. 11, 2013 for European Patent No. 11167785.2.
US Office Action issued May 23, 2013 for corresponding U.S. Appl. No. 13/067,371.

*Primary Examiner* — David Redding
(74) *Attorney, Agent, or Firm* — Staas & Halsey LLP

(57) ABSTRACT

A hand-held and stick vacuum cleaner includes a stick body having a body discharge part formed in a front part thereof and a first connecting terminal provided on a rear part thereof; and a hand-held cleaner unit detachably mounted in the rear part of the stick body and having discharge parts formed in front and rear part thereof and a second connecting terminal corresponding to the first connecting terminal provided on the rear part thereof.

8 Claims, 12 Drawing Sheets

HAND-HELD AND STICK VACUUM CLEANER

CROSS-REFERENCE TO RELATED APPLICATIONS

This application claims the benefit under 35 U.S.C. §119 (a) of Korean Patent Application No. 10-2010-0095024, filed on Sep. 30, 2010, in the Korean Intellectual Property Office, and U.S. Provisional Patent application No. 61/349,938, filed on May 31, 2010, in United States Patent and Trademark Office, the entire contents of which are hereby incorporated by reference.

BACKGROUND

1. Field

The present disclosure relates to a vacuum cleaner. More particularly, the present disclosure relates to a hand-held and stick vacuum cleaner, which can be converted to a hand-held vacuum cleaner or a stick vacuum cleaner.

2. Description of the Related Art

In general, a vacuum cleaner draws in a dust or dirt along with an air around it from a surface to be cleaned and filters and collects the dust or dirt from the air through a dust collecting apparatus. Particularly, a cyclone dust collecting apparatus, which forms a whirling current in the air and thus separates the dust or dirt therefrom using a centrifugal force generated by the whirling of air, does not requires replacing dust bags. Thus, the cyclone dust collecting apparatus can be semi-permanently used.

International Patent Publication WO 2008/088278 discloses a hand-held and stick vacuum cleaner, which can selectively carry out a handy type cleaning or a stick type cleaning. The disclosed hand-held and stick vacuum cleaner is configured, so that a hand-held cleaner unit is detachably mounted in a front part of a stick assembly. Accordingly, the hand-held and stick vacuum cleaner can carries out the cleaning operation in a state where the hand-held cleaner unit is mounted in the front part of the stick assembly (hereinafter, referred as "the stick type cleaning"), or in a state where the hand-held cleaner unit is not mounted in, but separated from the front part of the stick assembly (hereinafter, referred as "the hand-held type cleaning").

However, in the hand-held and stick vacuum cleaner disclosed in the international patent laid-open WO 2008/088278, there is an inconvenience in that when a user carries out the stick type cleaning with the stick assembly having the hand-held cleaner unit mounted therein and then tries to change the cleaning work from the stick type cleaning to the hand-held type cleaning, she or he should move in front of the hand-held and stick vacuum cleaner to separate the hand-held cleaner unit from the stick assembly because the hand-held cleaner unit is mounted in the front part of the stick assembly.

In addition, in the hand-held and stick vacuum cleaner as disclosed above, there is a problem in that even when the user carries out the stick type cleaning and then tries to take out a dust collecting bin from the hand-held cleaner unit, she or he should move in front of the hand-held and stick vacuum cleaner to separate the dust collecting bin from the hand-held and stick vacuum cleaner.

Also, in the hand-held and stick vacuum cleaner as disclosed above, there is a problem in that the user can not easily check a collected dust or dirt state in the dust collecting bin at the rear part of the hand-held and stick vacuum cleaner and must move to the front part of the hand-held and stick vacuum cleaner to check the collected dust or dirt state in the dust collecting bin because the hand-held cleaner unit is mounted in the front part of the stick assembly.

SUMMARY

An aspect of the present disclosure is to address at least the above problems and/or disadvantages and to provide at least the advantages described below. Accordingly, an aspect of the present disclosure is to provide a hand-held and stick cleaner, which has an improved convenience for use and an improved structure.

Another aspect of the present disclosure is to provide a hand-held and stick cleaner, which enables a user to more easily check a collected dust or dirt state in a dust collecting bin even while cleaning.

According to an aspect of the present disclosure, a hand-held and stick vacuum cleaner includes a stick body having a body discharge part formed in a front part thereof and a first connecting terminal provided on a rear part thereof, and a hand-held cleaner unit detachably mounted in the rear part of the stick body and having discharge parts formed in front and rear parts thereof and a second connecting terminal corresponding to the first connecting terminal provided on the rear part thereof.

The stick body may include a body-transparent part made of a transparent panel below the body discharge part of the stick body.

The hand-held cleaner unit may include a cyclone dust collecting apparatus having a transparent dust collecting bin to accommodate a separated dust or dirt, and may be configured to allow a user to check the dust or dirt in the dust collecting bin through the body-transparent part with her or his eyes when the hand-held cleaner unit is mounted in the rear part of the stick body.

The hand-held cleaner unit may further includes a body having a suction source contained therein, and a cyclone dust collecting apparatus detachably mounted in a mounting space penetrating through a lower part of the body.

The cyclone dust collecting apparatus may include a dust collecting bin made of a transparent material and having a cyclone inlet formed in a lower surface thereof, a cyclone bin disposed in the dust collecting bin to divide an inner space of the dust collecting bin into a dust storing chamber and a centrifugal chamber, a central pipe disposed in a center of the cyclone bin, a spiral guide member disposed between the cyclone bin and the central pipe to generate a whirling current in an air drawn into the cyclone bin, and a pre-motor filter unit to separate a fine dust or dirt from the air purified in the cyclone bin.

The pre-motor filter unit may include a lower casing having a convex grill inserted to a certain extent into the cyclone bin, an upper casing coupled to the lower casing and having a plurality of air holes, and a filter member disposed between the upper casing and the lower casing to filter the fine dust or dirt.

The stick body may further include a body connecting terminal provided on the lower part thereof to connect with an external charger, a housing to surround the body connecting terminal, and a wheel provided on an outer circumferential surface of the housing.

According to the foregoing description, the hand-held and stick vacuum cleaner of the present disclosure is configured, so that the hand-held cleaner unit is detachably mounted in the rear part of the stick body, thereby allowing the hand-held cleaner unit to be easily separated from or mounted in the stick body in order to perform an stick type cleaning or an hand-held type cleaning.

In addition, the hand-held and stick vacuum cleaner of the disclosure is configured so that the cyclone dust collecting apparatus is mounted in the mounting space penetrating through the body, the dust collecting bin and the cover member are transparent, and the body-transparent part is formed in the front part of the stick body. Accordingly, in the stick type cleaning, the user can easily check the collected dust or dirt state in the dust collecting bin with her or his eyes at a rear part of the hand-held and stick vacuum cleaner. Also, the user can check the collected dust or dirt state in the dust collecting bin with her or his eyes through the body-transparent part from a front part of the hand-held and stick vacuum cleaner.

BRIEF DESCRIPTION OF THE DRAWINGS

The above and other objects, features, and advantages of certain exemplary embodiments of the present disclosure will be more apparent from the following description taken in conjunction with the accompanying drawings, in which.

Throughout the drawings, the same reference numerals will be understood to refer to the same elements, features, and structures.

DETAILED DESCRIPTION

Hereinafter, a hand-held and stick vacuum cleaner according to certain exemplary embodiments of the present disclosure will be described in detail with reference to the accompanying drawing figures.

In the following description, the matters defined in the description, such as detailed construction and elements, are provided to assist in a comprehensive understanding of the invention. However, the present disclosure can be practiced without those specifically defined matters. Also, well-known functions or constructions are not described in detail since they would obscure the invention with unnecessary detail.

Figure 1:
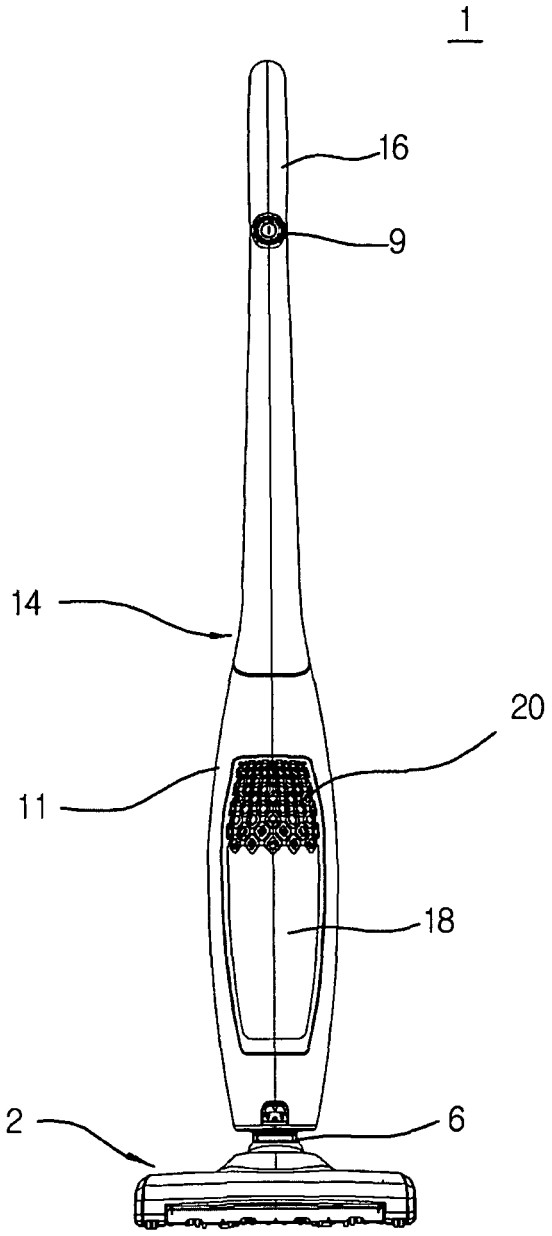
FIG. 1 is a front view showing a hand-held and stick vacuum cleaner according to an exemplary embodiment of the present disclosure.
Figure 2:
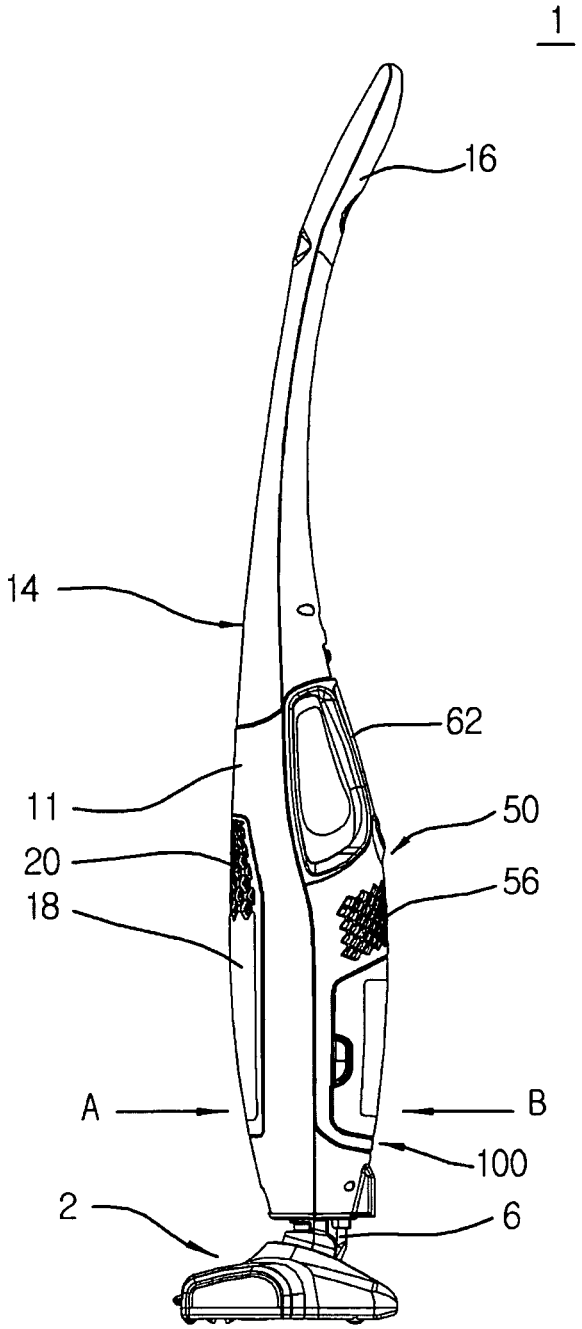
FIG. 2 is a right side view of the hand-held and stick vacuum cleaner according to the exemplary embodiment of the present disclosure.
Figure 3:
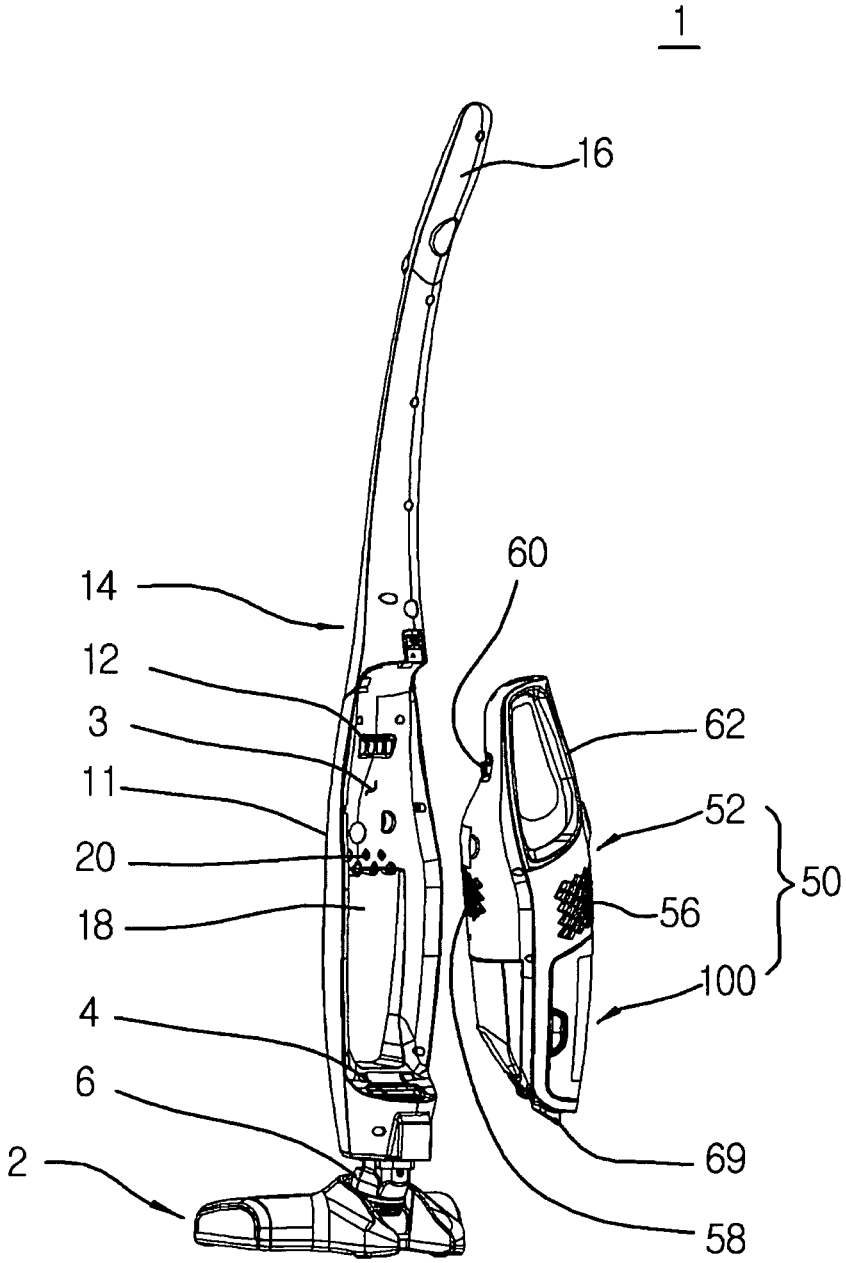
FIG. 3 is an exploded perspective view showing the hand-held and stick vacuum cleaner according to the exemplary embodiment of the present disclosure in which a hand-held cleaner unit is separated from a stick body.

FIGS. 1 and 2 are a front view and a right side view showing a hand-held and stick vacuum cleaner 1 according to an exemplary embodiment of the present disclosure, respectively, and FIG. 3 is an exploded perspective view showing the hand-held and stick vacuum cleaner 1 in which a hand-held cleaner unit 50 is separated from a stick body 14.

Referring to FIGS. 1 to 3, the hand-held and stick vacuum cleaner 1 according to the exemplary embodiment of the present disclosure includes a stick body 14, a nozzle assembly 2 and a hand-held cleaner unit 50.

The stick body 14 is divided into a handle 16 provided on an upper part thereof and a central part 11 in the form of a jar having a mounting space 3 provided on a lower part thereof. The handle 16, as a portion coupled to an upper end of the central part 11, is a portion, which is gripped by the user, so that she or he can push or pull the nozzle assembly 2 when using the hand-held and stick cleaner 1. The mounting space 3 formed in the central part 11 is a space, which can mount or separate the hand-held cleaner unit 50 in or from the stick body 14.

FIG. 1 is a view showing a front part of the stick body 14. In FIG. 2, the front part of the stick body 14 is a side of the stick body 14, which is viewed from a direction of arrow A, and a rear part of the stick body 14 is a side of the stick body 14, which is viewed from a direction of arrow B.

Referring to FIGS. 1 and 2, a body discharge part 20, which is made up of a plurality of discharge holes, is formed in the front part of the stick body 14, and a body-transparent part 18, which is made of a transparent panel, is formed below the body discharge part 20.

The nozzle assembly 2 is rotatably coupled to a lower end of the stick body 14, and an inner air passage 7 (see FIG. 5) in the nozzle assembly 2 is communicated with a neck part 6 and an opening 4 of the stick body 14. Accordingly, an external air and a dust or dirt drawn in through the nozzle assembly 2 are flowed into the hand-held cleaner unit 50 through the neck part 6 and the opening 4 of the stick body 14.

Figure 5:
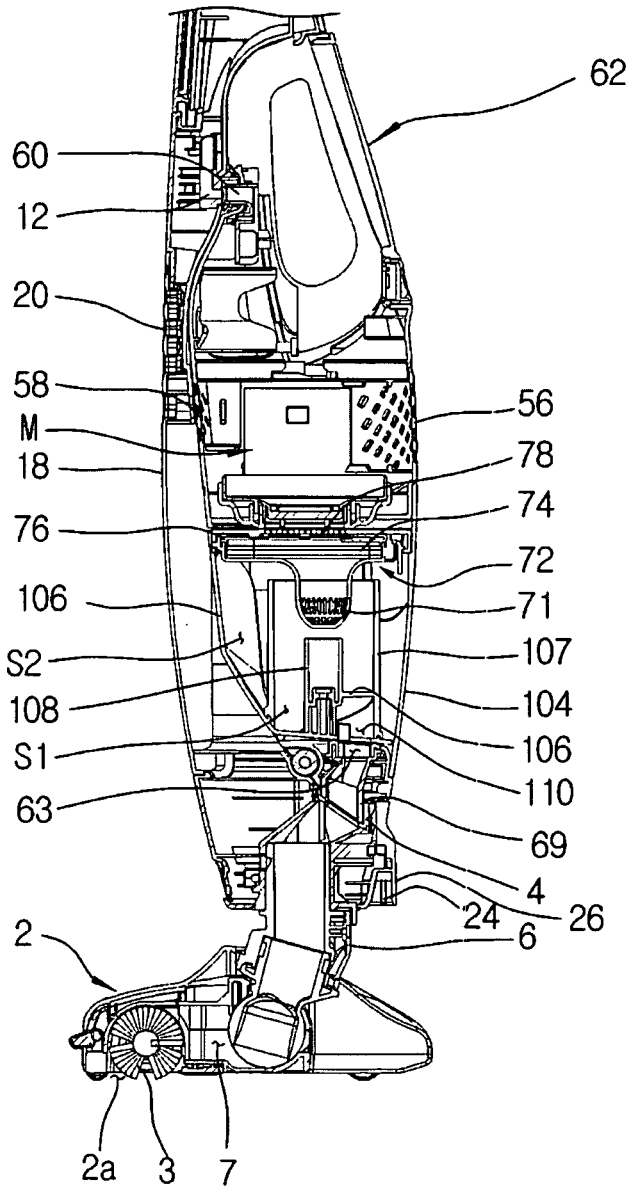
FIG. 5 is a cross-sectional view showing the hand-held and stick vacuum cleaner according to the exemplary embodiment of the present disclosure.

The nozzle assembly 2 has a bottom inlet port 2*a* for drawing in the air from a surface to be cleaned formed in a lower surface thereof and a cylindrical brush 3 for brushing off the dust or dirt from the surface to be cleaned rotatably disposed therein (see FIG. 5).

Figure 4:
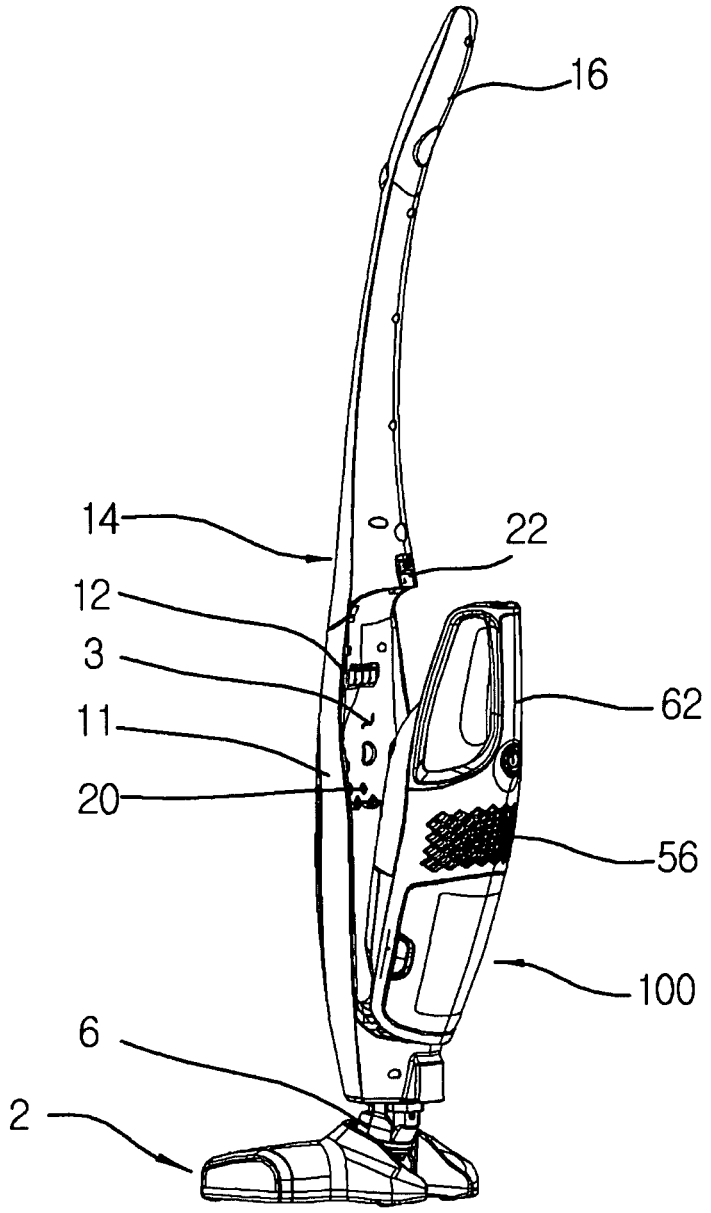
FIG. 4 is a perspective view showing the hand-held and stick vacuum cleaner according to the exemplary embodiment of the present disclosure in a state where the hand-held cleaner unit is mounted in the stick body.
Figure 6:
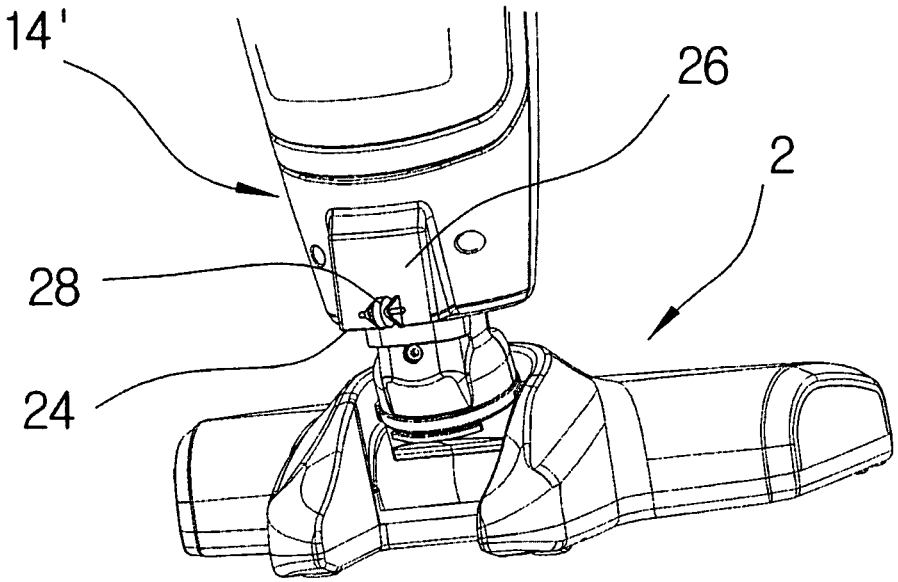
FIG. 6 is a partial view showing a modified example of the stick body shown in FIG. 2.

FIG. 4 is a perspective view showing the hand-held and stick vacuum cleaner 1 according to the exemplary embodiment of the present disclosure in a state where the hand-held cleaner unit 50 is mounted in the stick body 14, FIG. 5 is a cross-sectional view showing the hand-held and stick vacuum cleaner 1 according to the exemplary embodiment of the present disclosure, and FIG. 6 is a partial view showing a modified stick body 14' in order to explain a structure that a wheel 28 is disposed on a housing 25 of a body connecting terminal 24 on a lower end of the rear part of the stick body 14'.

Referring to FIGS. 3 and 4, a first connecting terminal 12 is provided in the mounting space 3 of the stick body 14 according to the exemplary embodiment of the present disclosure, and a second connecting terminal 60 is disposed on the rear part of the hand-held cleaner unit 50. If the hand-held cleaner unit 50 is mounted in the mounting space 3, the first and the second connecting terminals 12 and 60 come in contact with or to each other and thus the stick body 14 and the hand-held cleaner unit 50 are electrically connected. In FIG. 4, a reference number 22 is a locking button for fixing or separating the hand-held cleaner unit 50 in or from the mounting space 3.

Referring to FIG. 5, the stick body 14 at a lower end of the rear part thereof has a body connecting terminal 24 disposed to connect with a charger terminal 82 (see FIG. 7) and a housing 26 configured to surround or wrap the body connecting terminal 24 thus to prevent the body connecting terminal 24 from being contaminated.

A stick body 14' shown in FIG. 6 has the same structure as that of the stick body 14 according to the exemplary embodiment of the present disclosure shown in FIGS. 1 to 4, except that the wheel 28 is disposed on the housing 26. The wheel 28 is disposed on an outer surface of the housing 26, and when the user grips the handle 16 and lays down the stick body 14', rotates while being in contact with the surface to be cleaned thus to allow the stick body 14' to be easily moved and at the same time, to be supported. In addition, the wheel 28 restricts a rotation range of the stick body 14', so that other portions of the stick body 14' does not come in direct contact with the surface to be cleaned, thereby preventing the stick body 14' from being damaged due to excessive rotation thereof.

Figure 7:
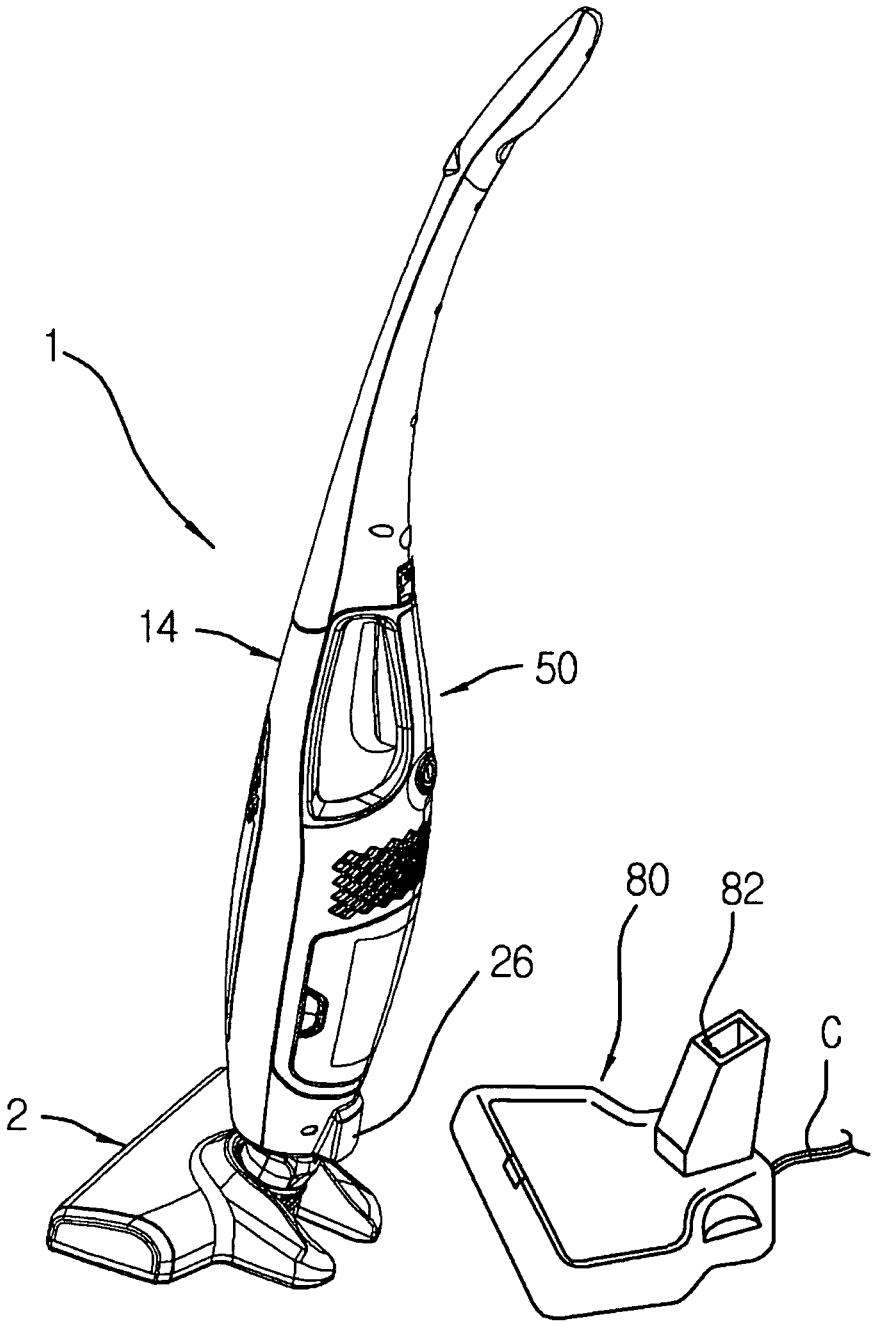
FIG. 7 is a perspective view showing the hand-held and stick vacuum cleaner and a charger according to the exemplary embodiment of the present disclosure.

FIG. 7 is a perspective view showing the hand-held and stick vacuum cleaner 1 and a charger 80. If the hand-held stick vacuum cleaner 1 is mounted on the charger 80, the body connecting terminal 24 is inserted into and connected to the charger terminal 82 of the charger 80. When the body connecting, terminal 24 is connected to the charger terminal 82, a commercial electric power is applied to the body connecting terminal 24 through an electric wire C, and the applied electric power charges a battery (not shown) disposed in the hand-held cleaner unit 50 through the first connecting terminal 12 (the first connecting terminal 12 and the second connecting terminal 60 of the hand-held cleaner unit 50 are connected with or to each other while coming in contact therewith in a state where the hand-held cleaner unit 50 is mounted in the mounting space 3 as shown in FIG. 8).

Figure 8:
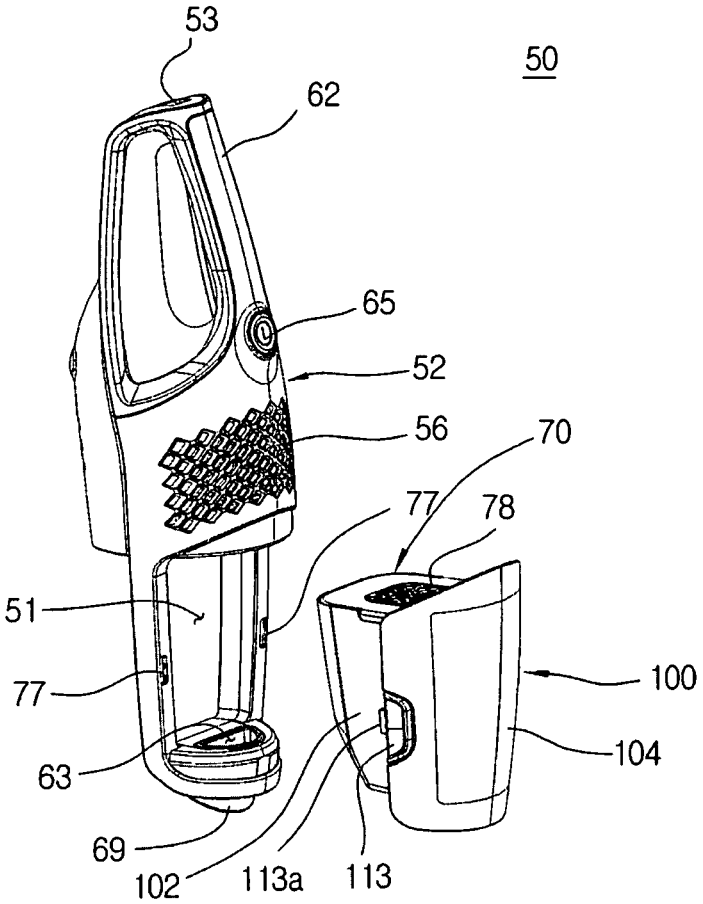
FIG. 8 is a perspective view showing the hand-held cleaner unit of FIG. 2 in a state where a cyclone dust collecting apparatus is separated from a body.
Figure 9:
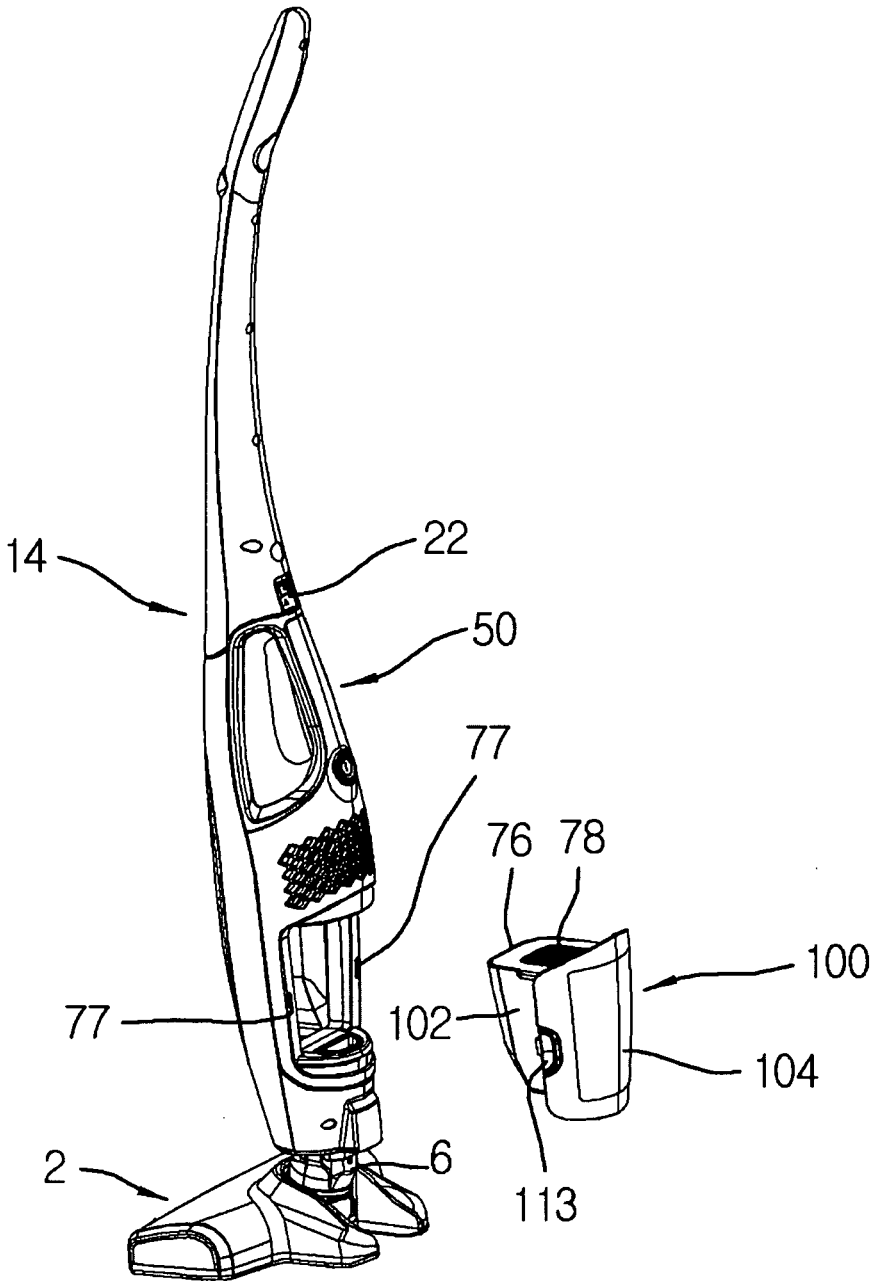
FIG. 9 is a perspective view showing the hand-held and stick vacuum cleaner of FIG. 2 in a state where the cyclone dust collecting apparatus is separated therefrom.

Referring to FIG. 8, the hand-held cleaner unit 50 includes a body 52 and a cyclone dust collecting apparatus 100.

On a front part of the body 52 are provided a first discharge part 56 in the form of a grill having a plurality of discharge holes, a handle 62 and a power button 65. A vacuum source M (see FIG. 5) for generating a suction force and the battery (not shown) are mounted in an upper part of the body 52. On a rear part of the body 52, a second discharge part 58 (see FIG. 3) in the form of a grill having a plurality of discharge holes is formed at a position opposite to that of the first discharge part 56. On the rear part of the body 52, the second connecting terminal 60 (see FIG. 3) is disposed on an upper part of the second discharge part 58. A roller 114 (see FIG. 11) is rotatably disposed in the vicinity of a lower end of the body 52. An air discharged to the second discharge part 58 is discharged to the front part of the stick body 14 through the body discharge part 20 formed in the stick body 14 (see FIG. 3). A cyclone mounting space 51 in which the cyclone dust collecting apparatus 100 is mounted is penetrated through and formed in the lower part of the body 52.

Figure 10:
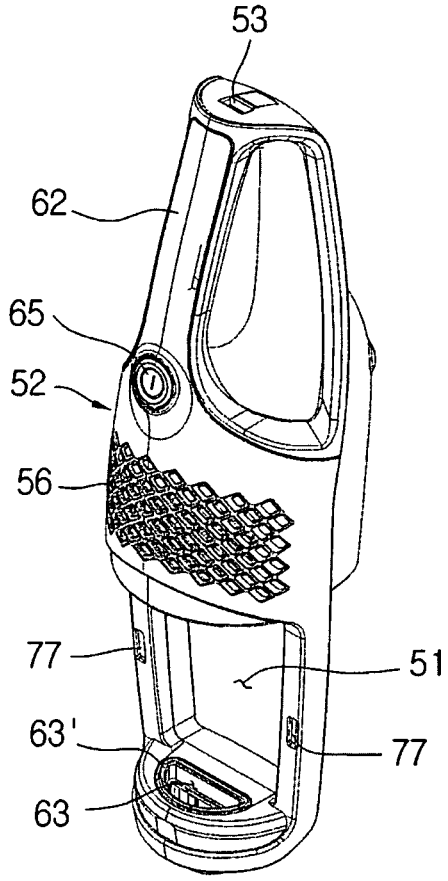
FIG. 10 is a perspective view showing the hand-held cleaner unit of FIG. 2 from which the cyclone dust collecting apparatus is removed in a state where it stands up.
Figure 11:
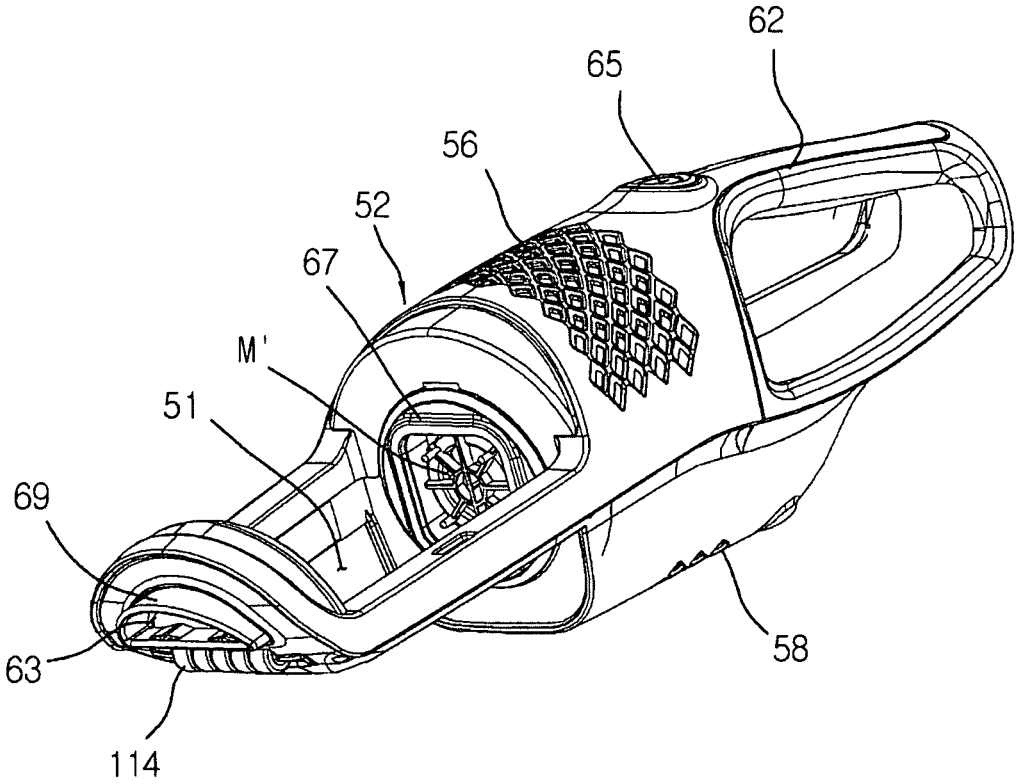
FIG. 11 is a perspective view showing the hand-held cleaner unit of FIG. 10 in a state where it lies down.

Referring to FIGS. 10 to 11, the body 52 further includes a cleaner inlet port 63, the roller 114, an inlet gasket 63', an outlet gasket 67, and a rib 69. The cleaner inlet port 63 is coupled with the opening 4 of the stick body 14 and a cyclone inlet 110 (see FIGS. 5 and 13) while being in tight contact therewith.

Figure 13:
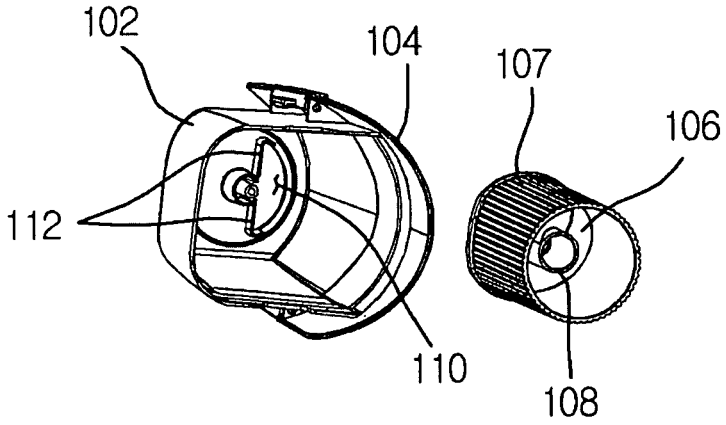
FIG. 13 is a perspective view showing a dust collecting bin and a cyclone bin of the cyclone dust collecting apparatus of FIG. 12, as viewed from above.

The inlet gasket 63' is disposed on a circumferential surface of the cleaner inlet port 63 to prevent an air from being leaked through coupled portions of the cleaner inlet port 63 and the cyclone inlet 110 (see FIGS. 5 and 13).

The outlet gasket 67 is disposed around a motor inlet port M' formed on an upper part of the cyclone mounting space 51 to increase a contact force of coupled portions between a pre-motor filter unit 70 and the body 52 thus to prevent an air from being leaked therethrough.

The roller 114 is disposed on a lower part of the cleaner inlet port 63, and when the hand-held cleaner unit 50 is used being separated from the stick body 14, rotates while being in contact with the surface to be cleaned thus to allow the hand-held cleaner unit 50 to easily move back and forth and to reduce friction between the surface to be cleaned and the hand-held cleaner unit 50.

The rib 69 is formed on and projected from the cleaner inlet port 63, and when the hand-held cleaner unit 50 is mounted in the mounting space 3, is inserted into the opening 4 of the stick body 14 to prevent an air from being leaked between the cleaner inlet port 63 and the opening 4. In addition, when the hand-held cleaner unit 50 is tilted to allow the cleaner inlet port 63 to be in contact with the surface to be cleaned, the rib 69 reduces a separated space between the surface to be cleaned and the cleaner inlet port 63 to allow the suction force of the vacuum source M to be transmitted to the surface to be cleaned well, thereby improving dust suction performance of the hand-held cleaner unit 50 to the surface to be cleaned.

Figure 12:
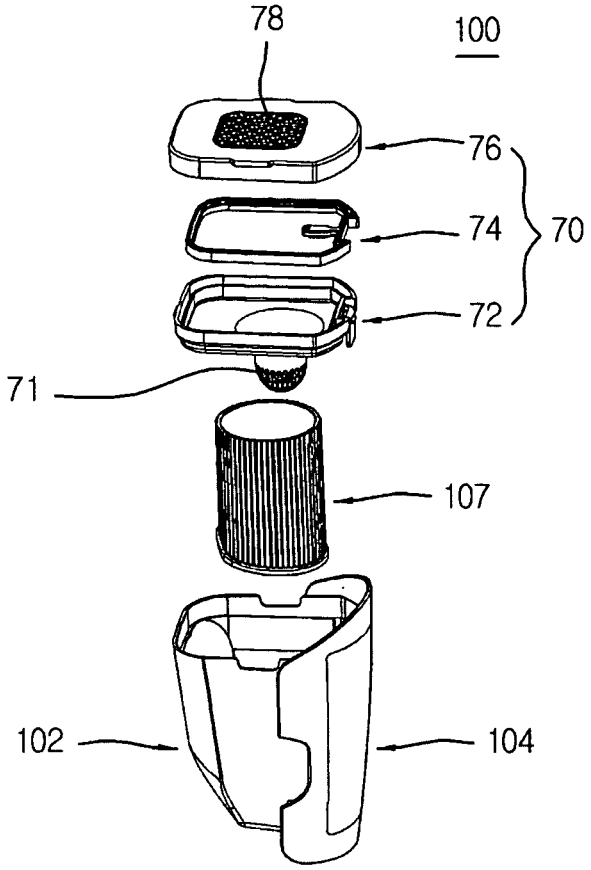
FIG. 12 is an exploded perspective view showing the cyclone dust collecting apparatus of the hand-held and stick vacuum cleaner according to the exemplary embodiment of the present disclosure.

Referring to FIGS. 12 and 13, the cyclone dust collecting apparatus 100 includes a dust collecting bin 102, a cover member 104, a pre-motor filter unit 70 and a cyclone bin 107.

The dust collecting bin 102 is made of a transparent material and has an approximately rectangle shape. The pre-motor filter unit 70 is detachably mounted on a side of the duct collecting bin 102.

The cover member 104 is made of a transparent material and integrally formed with the dust collecting bin 102. The cover member 104 forms an outer surface of the hand-held cleaner unit 50 when the cyclone dust collecting apparatus 100 is mounted in the cyclone mounting space 51 of the hand-held cleaner unit 50.

On both side ends of the cover member 104 is disposed a pair of locking members 113, which is able to be hinged and elastically supported by springs (not shown). Thus, the user can push the pair of locking members 113 with her or his one hand to lock or release them in or from locking grooves 77 (see FIG. 10) formed on both sides of the cyclone mounting space 51 of the body 52, thereby assembling or separating the cyclone dust collecting apparatus 100 in or from the body 52.

Since in the cyclone dust collecting apparatus 100, the dust collecting bin 102 and the cover member 104 are transparent, the user can check the amount of dust collected in the dust collecting bin 102 or the operation state of the cyclone dust collecting apparatus 100 with her or his eyes from the outside. Even when the cyclone dust collecting apparatus 100 is mounted in the cyclone mounting space 51 (see FIG. 10), the user can see the inside of the cyclone dust collecting apparatus 100 from the front part and the rear part of the hand-held cleaner unit 50.

Even when the hand-held cleaner unit 50 is mounted in the stick body 14, as shown in FIG. 1, the user can see the inside of the cyclone dust collecting apparatus 100 through a front part of a hand-held and stick vacuum cleaner 1. In other words, through the body-transparent part 18 of the stick body 14, the user can check the inside of the cyclone dust collecting apparatus 100 with her or his eyes.

The user can see the inside of the cyclone dust collecting apparatus 100 through a rear part of the hand-held and stick vacuum cleaner 1. In other words, when the hand-held and stick vacuum cleaner 1 is used as a stick type, the user can check the inside of the cyclone dust collecting apparatus 100 through the rear part (the arrow B in FIG. 2) of the hand-held and stick vacuum cleaner 1 even if she or he does not move in front of the hand-held and stick vacuum cleaner 1.

Referring to FIGS. 5, 12 and 13, the cyclone bin 107 is disposed in the dust collecting bin 102 to divide an inner space of the dust collecting bin 102 into a centrifugal chamber S1 and a dust accommodating chamber S2 (see FIG. 5). A central pipe 108 is provided in a center of the cyclone bin 107, and a spiral flow path-guide member 106 for inducing a rotation of air drawn in through a cyclone inlet 110 is disposed between the cyclone bin 107 and the central pipe 108.

The pre-motor filter unit 70 is disposed to be coupled to an upper part of the dust collecting bin 102, and includes an upper casing 76, a lower casing 72, and a filter member 74. A grill 71 is convexly projected from the lower casing 72, and a plurality of air holes 78 for discharge the air is formed in the upper casing 76. The filter member 74 is mounted between the upper casing 76 and the lower casing 72. When the pre-motor filter unit 70 is mounted in the dust collecting bin 102, the convex grill 71 is inserted to a certain extent into the cyclone bin 107, that is, the centrifugal chamber S1. The convex grill 71 allows the air to maintain a whirling force in an upper part of the cyclone bin 107, and first filters a relatively large dust or dirt from the air discharged from the centrifugal chamber S1. Further, the filter member 74 secondly separates a fine dust or dirt from the air past the grill 71.

As shown in FIG. 8, when the cyclone duct collecting apparatus 100 is separated from the hand-held cleaner unit 50, the pre-motor filter unit 70 along with the cyclone duct collecting apparatus 100 is separated therefrom. To dump the dust or dirt, the user should separate the pre-motor filter unit 70 from the cyclone duct collecting apparatus 100. Thus, whenever the user dumps the dust or dirt, she or he can naturally check contamination levels of the pre-motor filter unit 70 and timely replace the filter member 74 with a new one.

Referring to FIGS. 8 and 13, the cyclone inlet 110 is formed in a lower surface of the dust collecting bin 102 to come in tight contact with the cleaner inlet port 63, and has a semicircle shape. Around an inner side of the cyclone inlet 110 is provided an anti-back flow rib 112, which is projected toward the inside of the dust collecting bin 102. Although the anti-back flow rib 112 is illustrated as being provided on a portion of a circumference of the cyclone inlet 110, it may be formed on the entire circumference of the cyclone inlet 110 to project to a certain distance into the cyclone bin 107 therefrom. The anti-back flow rib 112 acts to prevent the dust or dirt remained in the cyclone bin 107 from flowing out through the cyclone inlet 110.

Referring to FIG. 5, the central pipe 108 and the flow path-guide member 106 are disposed in the cyclone bin 107. The flow path-guide member 106 has a spiral shape, and is disposed between an outer surface of the central pipe 108 and an inner surface of the cyclone bin 107. The air drawn in through the cyclone inlet 110 rides on the flow path-guide member 106 and rotates while forming the whirling current to separate the dust or dirt therefrom.

Hereinafter, an operation the hand-held and stick vacuum cleaner 1 according to the exemplary embodiment of the present disclosure will be explained with reference to the drawings as described above.

Referring to FIG. 1, if the user mounts the hand-held cleaner unit 50 in the stick body 14 in order to use the hand-held and stick cleaner (hereinafter, referred as 'stick type cleaning'), she or he pushes a power switch 9 disposed on the stick body 14 to operate the hand-held and stick vacuum cleaner 1, and then grips the handle 16 of the stick body 14 with her or his hand and uses the stick body 14, tilting the stick body 14 to the nozzle assembly 2. In case of the modified stick body 14' as shown in FIG. 6, if the user tilts the stick body 14 to the maximum while maintaining the nozzle assembly 2 in a state where it is in contact with a surface to be cleaned, the wheel 28 disposed on the rear part of the stick body 14' comes in contact with the surface to be cleaned.

The user properly tilts the stick body 14 to meet her or his physical condition, and then cleans the surface to be cleaned while moving the hand-held and stick vacuum cleaner 1 in every direction. Referring to FIG. 5, an external air laden with a dust or dirt is flowed into the cyclone dust collecting apparatus 100 via the nozzle assembly 2, the neck part 6 and the opening 4 of the stick body 14. The external air that flows into the cyclone dust collecting apparatus 100 whirls in the centrifugal chamber S1, and the dust or dirt included in the external air is separated from the external air by the whirling centrifugal force and stored in the dust collecting bin 102.

The air from which the dust or dirt is separated passes through the pre-motor filter unit 70 to remove a fine dust or dirt therefrom by means of the grill 71 and the filter member 74, and then is discharged to the first and the second discharge parts 56 and 58 of the hand-held cleaner unit 50 via the vacuum source M. Among this air, the air discharged to the second discharge part 58 is discharged to the front part of the stick body 14 through the body discharge part 20.

The user can separate the hand-held cleaner unit 50 from the rear part of the stick body 14 to clean the surface to be cleaned by using only the hand-held cleaner unit 50 (hereinafter, referred as 'hand-held type cleaning'). Referring to FIG. 8, in the hand-held type cleaning, the user turns on/off the vacuum source M disposed in the body 52 by using the power button 65 disposed on the body 52. To draw in an external air and a dust or dirt from the surface to be cleaned, the user can move the hand-held cleaner unit 50 while bringing the cleaner inlet port 63 and the roller 114 (see FIG. 11) to be in contact with the surface to be cleaned.

The operation of the hand-held cleaner unit 50 allows the external air to flow into the cyclone dust collecting apparatus 100 through the cleaner inlet port 63 and the cyclone inlet 110. A dust collecting operation in the cyclone dust collecting apparatus 100 is the same as that in the stick type cleaning. The air from which the dust or dirt is separated in the cyclone dust collecting apparatus 100 is discharged to the first and the second discharge parts 56 and 58 through the pre-motor filter unit 70 and the vacuum source M.

With the hand-held and stick cleaner 1 of the exemplary embodiment of the disclosure, the user pushes or pulls the hand-held and stick cleaner 1 to clean the surface to be cleaned while being positioned to the rear part thereof when carrying out the stick type cleaning. In this state, if the user wants to change the cleaning work form from the stick type cleaning to the hand-held type cleaning, she or he only conveniently and quickly separate the hand-held cleaner unit 50 from the rear part of the stick body 14 and then carry out the hand-held type cleaning by using the separated hand-held cleaner unit 50 in a posture for the stick type cleaning without moving to the front part of the stick body 14.

The hand-held and stick cleaner 1 of the exemplary embodiment of the disclosure has the body discharge part 20 provided in the front part of the stick body 14 and the first connecting terminal 12 provided on the rear part of the stick body 14. Further, the first discharge part 56 is provided in the front part of the hand-held cleaner unit 50 and the second discharge part 58 and the second connecting terminal 60 are provided at the rear part of the hand-held cleaner unit 50. Accordingly, if the hand-held cleaner unit 50 is mounted in the mounting unit 3, the second discharge part 58 is communicated with the body discharge part 20, so that the air discharged to the second discharge part 58 is discharged to the front part of the stick body 14 through the body discharge part 20. Also, the first and the second connecting terminals 12 and 60 are coupled with or to each other and thus the stick body 14 and the hand-held cleaner unit 50 are electrically connected.

In the hand-held and stick cleaner 1 of the exemplary embodiment of the disclosure, the dust collecting bin 102 and the cover member 104 of the cyclone dust collecting apparatus 100 is made of the transparent material and the body-transparent part 18 is also provided in the front part of the stick body 14. Accordingly, a visibility to the inside of the dust collecting bin 102 is improved, thereby allowing the user to easily check the operation state of the cleaner. In other words, even when the hand-held cleaner unit 50 is mounted in the mounting space 3, the user can check the operation state of the cyclone dust collecting apparatus 100 and the collected dust or dirt state in the dust collecting bin 102 through the front part and the rear part of the stick body 14. In particular, in the stick type cleaning, the user, which carries out the cleaning work at the rear part of the hand-held and cleaner 1, can check the collected dust or dirt state in the dust collecting bin 102 with her or his eyes from the rear part of the hand-held and stick vacuum cleaner 1 even if she or he does not move to the front part of the hand-held and stick vacuum cleaner 1.

Further, in the hand-held and stick cleaner 1 of the exemplary embodiment of the disclosure, the body connecting terminal 24 disposed on the rear part of the stick body 14 has the structure that it is disposed in the housing 26, that is, the structure that it is surrounded or wrapped by the housing 26, thereby allowing it to reduce pollution in the use or the storing of the cleaner and thus to prevent a short circuit, a poor charge or the like due to the pollution. Also, the wheel 28 may be disposed on the outer surface of the housing surrounding the body connecting terminal 24, so that it allows the hand-held and cleaner 1 to easily move and restricts the rotation range of the stick body 14', thereby preventing the stick body 14' from being damaged due to excessive rotation thereof.

In the hand-held and stick cleaner 1 of the exemplary embodiment of the disclosure, the cyclone dust collecting apparatus 100 is configured, so that the cyclone inlet 110 is formed on the lower surface of the dust collecting bin 102 and the pre-motor filter unit 70 including the grill 71 opposite to the cyclone inlet 110 is detachably disposed on the upper end of the dust collecting bin 102, thereby preventing a flowing direction of air from being excessively changed in the cyclone dust collecting apparatus 100. In other words, the flowing direction of air is not sharply curved or converted at an angle of 180°, and the air flow is in a straight line except that it rotates. Accordingly, in the cyclone dust collecting apparatus 100, a loss in pressure is reduced and a dust collecting efficiency is improved. In addition, the anti-back flow rib 112 is internally projected and disposed in the cyclone inlet 110, thereby preventing the dust or dirt in the cyclone bin 107 from flowing backward through the cyclone inlet 110 and thus allowing convenience for use to improve.

Although representative embodiments of the present disclosure have been shown and described in order to exemplify the principle of the present disclosure, the present disclosure is not limited to the specific embodiments. It will be understood that various modifications and changes can be made by one skilled in the art without departing from the spirit and scope of the disclosure as defined by the appended claims. Therefore, it shall be considered that such modifications, changes and equivalents thereof are all included within the scope of the present disclosure.

What is claimed is:

1. A hand-held and stick vacuum cleaner, comprising:

a stick body having a body discharge part formed in a front part thereof and a first connecting terminal provided on a rear part thereof; and a hand-held cleaner unit detachably mounted in the rear part of the stick body and having discharge parts formed in front and rear part thereof and a second connecting terminal corresponding to the first connecting terminal provided on the rear part thereof.

2. The cleaner as claimed in claim 1, wherein the stick body comprises a body-transparent part made of a transparent panel below the body discharge part of the stick body.

3. The cleaner as claimed in claim 2, wherein the hand-held cleaner unit comprises a cyclone dust collecting apparatus having a transparent dust collecting bin to accommodate a separated dust or dirt, and is configured to allow a user to check the dust or dirt in the dust collecting bin with her or his eyes through the body-transparent part when the hand-held cleaner unit is mounted in the rear part of the stick body.

4. The cleaner as claimed in claim 2, wherein the hand-held cleaner unit further comprises:

a body having a suction source contained therein; and a cyclone dust collecting apparatus detachably mounted in a mounting space penetrating through a lower part of the body.

5. The cleaner as claimed in claim 4, wherein the cyclone dust collecting apparatus comprises:

a dust collecting bin made of a transparent material and having a cyclone inlet formed in a lower surface thereof;

a cyclone bin disposed in the dust collecting bin to divide an inner space of the dust collecting bin into a dust storing chamber and a centrifugal chamber;

a central pipe disposed in a center of the cyclone bin;

a spiral guide member disposed between the cyclone bin and the central pipe to generate a whirling current in an air drawn into the cyclone bin; and a pre-motor filter unit detachably coupled to an upper end of the dust collecting bin to separate a fine dust or dirt from the air purified in the cyclone bin.

6. The cleaner as claimed in claim 5, wherein the pre-motor filter unit comprises:

a lower casing having a convex grill inserted to a certain extent into the cyclone bin;

an upper casing coupled to the lower casing and having a plurality of air holes; and a filter member disposed between the upper casing and the lower casing to filter the fine dust or dirt.

7. The cleaner as claimed in claim 1, wherein the stick body further comprises:

a body connecting terminal provided on the lower part thereof to connect with an external charger;

a housing to surround the body connecting terminal; and a wheel provided on an outer circumferential surface of the housing.

8. The cleaner as claimed in claim 4, wherein the hand-held cleaner unit further comprises:

a first discharge part formed on a front part of the body in the form of a grill having a plurality of discharge holes;

a handle a power button;

a vacuum source to generate a suction force mounted in an upper part of the body 52;

a second discharge part formed on a rear part of the body in the form of a grill having a plurality of discharge holes wherein an air discharged to the second discharge part is discharged to the front part of the stick body through a stick body discharge part formed in the stick body.

* * * * *